US007051961B2

(12) United States Patent
Mills et al.

(10) Patent No.: US 7,051,961 B2
(45) Date of Patent: May 30, 2006

(54) FUEL INJECTOR WITH A COATING

(75) Inventors: John R Mills, Williamsburg, VA (US); Jordi J Catasus-Servia, Williamsburg, VA (US)

(73) Assignee: Synerject, LLC, Newport News, VA (US)

( * ) Notice: Subject to any disclaimer, the term of this patent is extended or adjusted under 35 U.S.C. 154(b) by 306 days.

(21) Appl. No.: 10/163,498

(22) Filed: Jun. 7, 2002

(65) Prior Publication Data

US 2003/0226914 A1 Dec. 11, 2003

(51) Int. Cl.
*F02M 47/02* (2006.01)
*F02M 59/00* (2006.01)
*B05B 1/30* (2006.01)

(52) U.S. Cl. ..... 239/585.4; 239/585.1; 239/585.3; 239/585.4; 239/533.2; 239/88

(58) Field of Classification Search .. 239/585.1–585.5, 239/533.2, 533.3, 88–94, 1, 5; 251/129.15, 251/129.21, 127; 29/890.124, 890.127
See application file for complete search history.

(56) References Cited

U.S. PATENT DOCUMENTS 2,627,259 A 2/1953 Wood et al.
3,773,265 A * 11/1973 Kent ..... 239/585.4
4,075,999 A 2/1978 Danis
4,212,602 A 7/1980 Buran et al.
4,552,311 A * 11/1985 Casey ..... 239/585.4
4,714,198 A * 12/1987 Savkar ..... 239/409
4,867,116 A 9/1989 de Freitas Couto Rosa et al.
4,871,434 A 10/1989 Munz et al.
5,040,501 A 8/1991 Lemelson
5,069,189 A 12/1991 Saito
5,173,339 A 12/1992 Singer
5,226,975 A * 7/1993 Denton et al. ..... 148/220
5,271,823 A 12/1993 Schachameyer et al.
5,474,234 A 12/1995 Maley
5,752,308 A 5/1998 Maley et al.
5,819,774 A 10/1998 Beardsley et al.

(Continued)

FOREIGN PATENT DOCUMENTS

EP 0 818 622 B1 11/2000

OTHER PUBLICATIONS

ARMOLOY of Western PA., Inc. home page from www.armoloy-wpa.com, printed Apr. 1, 2002, 4 pages.

(Continued)

*Primary Examiner*—Davis Hwu
(74) *Attorney, Agent, or Firm*—Cooley Godward LLP

(57) ABSTRACT

An assembly for a fuel injector having a metallic armature and a metallic poppet attached to the armature at an interface location. The armature and/or the poppet includes a coating at the interface location, where the coating has a higher resistance to corrosion as compared to the base material of the poppet and/or the base material of the armature.

51 Claims, 10 Drawing Sheets

U.S. PATENT DOCUMENTS

| | | | | |
|---|---|---|---|---|
| 5,888,316 | A * | 3/1999 | Erickson | 148/410 |
| 5,904,125 | A | 5/1999 | Enright et al. | |
| 5,937,520 | A * | 8/1999 | Earhart et al. | 29/890.13 |
| 5,996,227 | A | 12/1999 | Reiter et al. | |
| 6,062,499 | A | 5/2000 | Nakamura et al. | |
| 6,145,763 | A | 11/2000 | Fleming et al. | |
| 6,302,337 | B1 | 10/2001 | Kimmel | |
| 6,311,901 | B1 | 11/2001 | Imoehl et al. | |
| 6,484,700 | B1 | 11/2002 | Kimmel et al. | |
| 6,561,167 | B1 | 5/2003 | Berndt | |

OTHER PUBLICATIONS

Kolene SBN Salt Bath Nitriding Processes, www.finishing.com/kolene/nitriding.html, printed Apr. 1, 2002, 1 page.

Balzers Inc., Coating Offerings, www.btc.balzers.com/pages/coating.html, printed Apr. 1, 2002, 4 pages.

International Search Report mailed Oct. 20, 2003 in connection with International Patent Application No. PCT/US03/17657.

* cited by examiner

UNCOATED CONTROL

UNCOATED CONTROL

COATED TEST

COATED TEST

FUEL INJECTOR WITH A COATING

BACKGROUND OF THE INVENTION

1. Field of the Invention

The present invention relates to fuel injectors, and more particularly fuel injectors having coated components.

2. Description of the Related Art

Conventional fuel injectors include metallic components that are attached such that they move jointly within the fuel injectors. For example, during manufacture of some air assist fuel injectors, a poppet of a first material is press fit into a receiving portion of an armature of a second material. During this press fitting process, the poppet and armatures are often galled such that air pockets form between the surface of the armature and the surface of the poppet. After the poppet is press fit to the armature, they are typically welded together. During operation of the fuel injector, the armature and the poppet move in a reciprocating linear motion within the fuel injector. Although the poppet and the armature typically do not move with respect to one another, the base material of the poppet and armature occasionally corrodes near or at the poppet-armature interface where the poppet is attached to the armature. The dissimilar materials, the air pockets, and the weld connection are thought to contribute to galvanic corrosion, crevice corrosion, and intergranular corrosion at the poppet-armature interface of these conventional fuel injectors. Additionally, the poppet-armature interface is thought to be susceptible to stress corrosion cracking as these components are often subjected to tensile stresses and corrosive environments.

SUMMARY OF THE INVENTION

In light of the above-described problems of some conventional fuel injectors, embodiments of the present invention generally strive to provide fuel injectors that include a coating at the poppet-armature interface, where the coating helps reduce corrosion of the base material of the poppet and/or the base material of the armature.

Other advantages and features associated with the embodiments of the present invention will become more readily apparent to those skilled in the art from the following detailed description. As will be realized, the invention is capable of other and different embodiments, and its several details are capable of modification in various obvious aspects, all without departing from the invention. Accordingly, the drawings in the description are to be regarded as illustrative in nature, and not limitative.

DETAILED DESCRIPTION OF PREFERRED EMBODIMENTS

Figure 1:
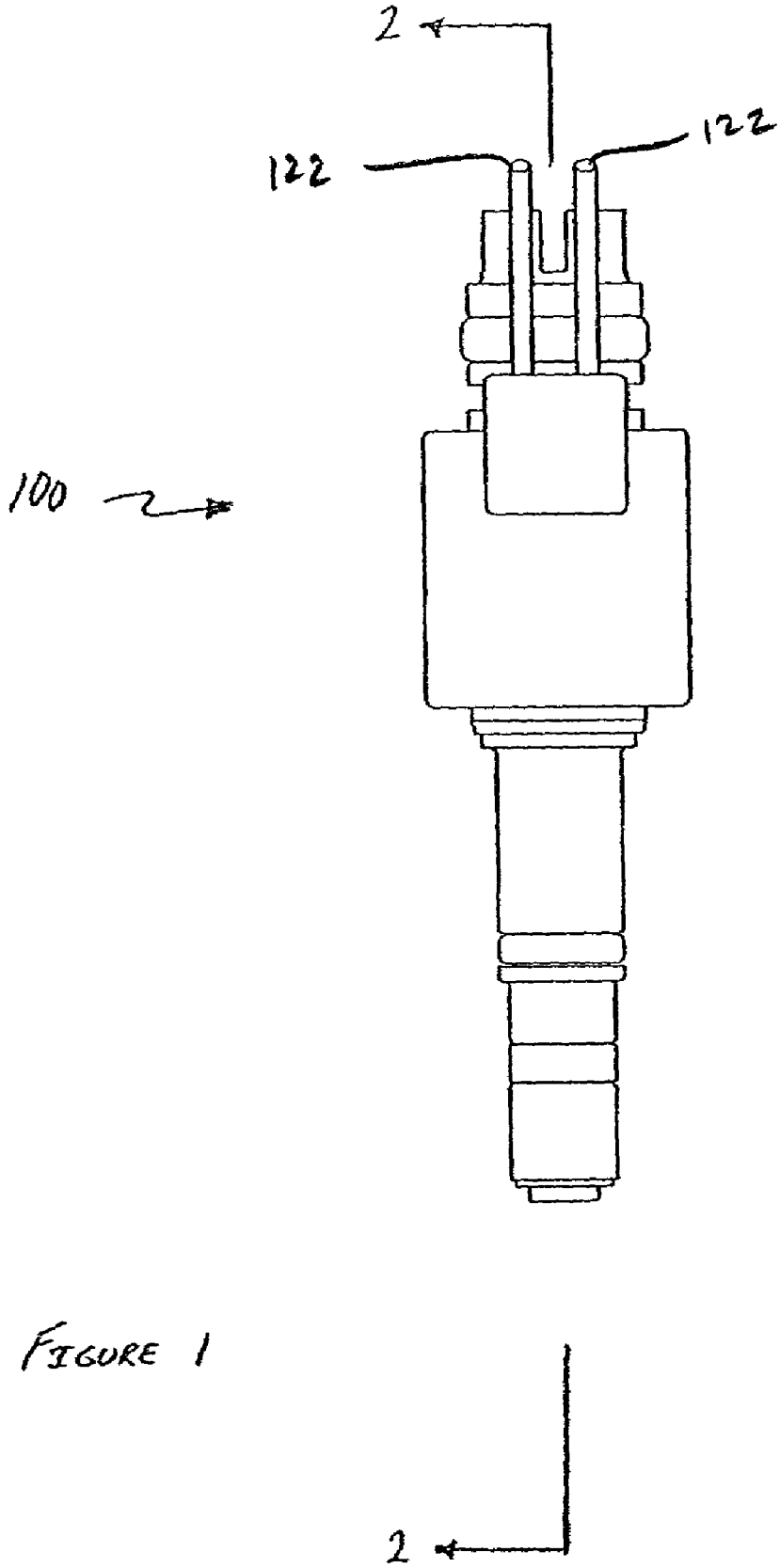
FIG. 1 is a side view of a fuel injector in accordance with one embodiment of the present invention.
Figure 2:
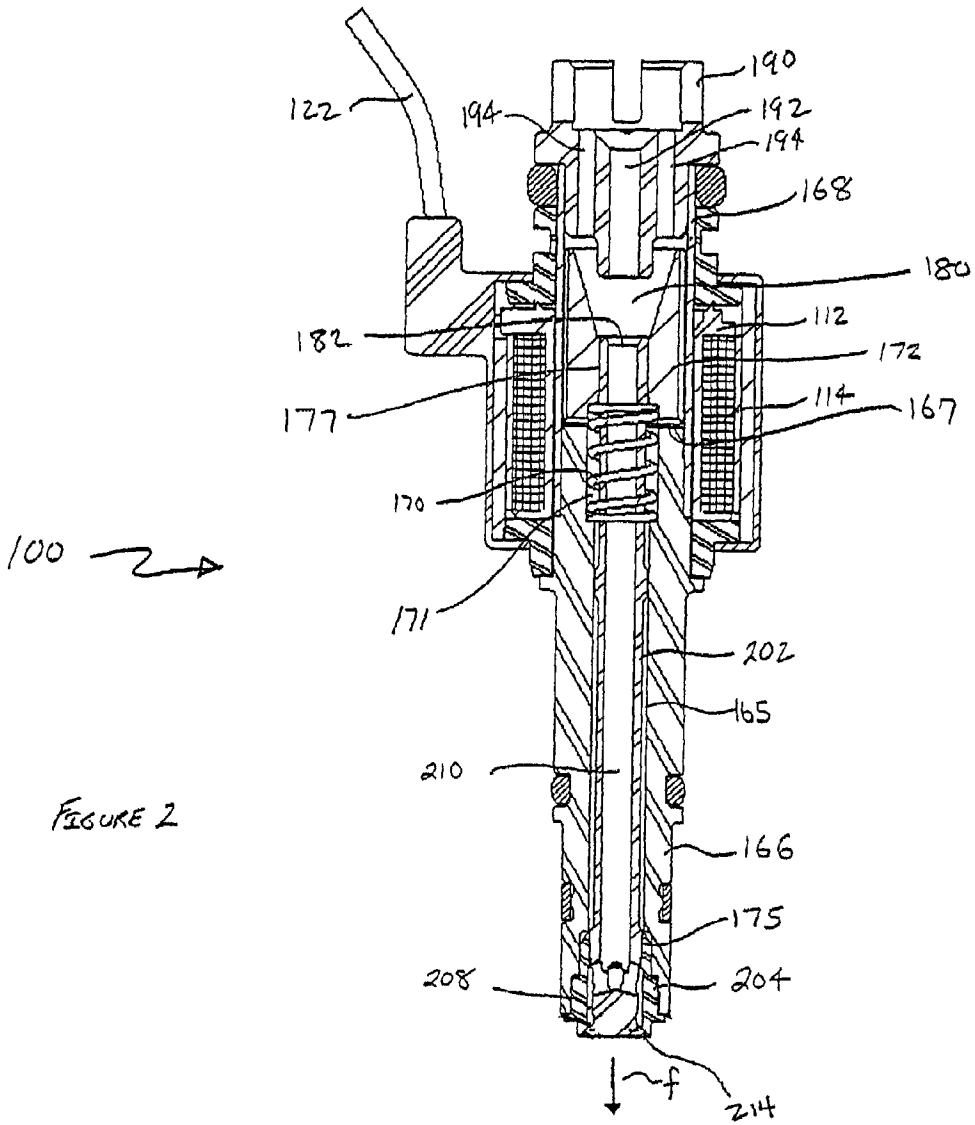
FIG. 2 is a cross-sectional view of the fuel injector illustrated in FIG. 1 taken along the line 2—2 in FIG. 1.
Figure 3:
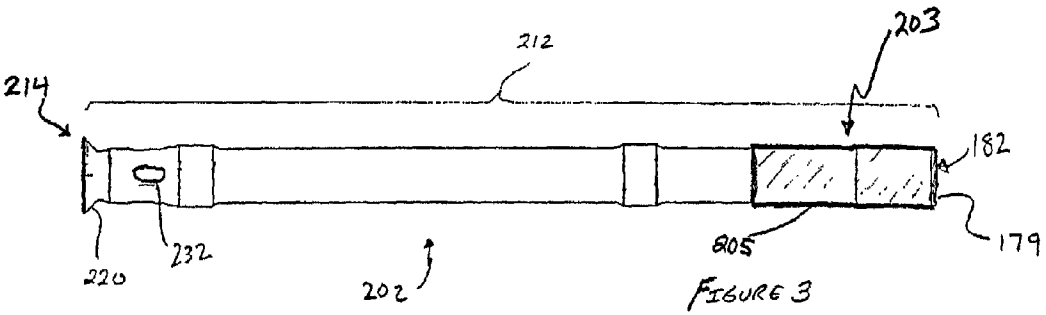
FIG. 3 is side view of the poppet of the fuel injector of FIG. 1.
Figure 4:
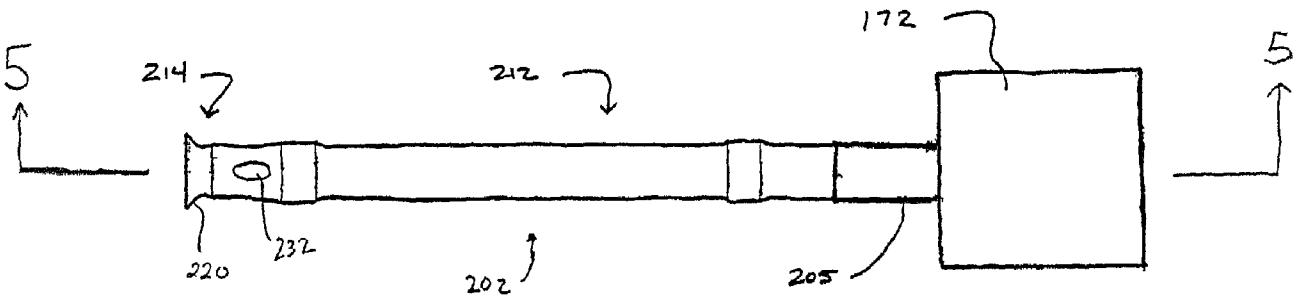
FIG. 4 is a side view of the poppet and an armature of the fuel injector of FIG. 1, where the poppet is attached to the armature.

FIGS. 1 and 2 illustrate a fuel injector 100 according to one embodiment of the present invention. As described below, in the preferred embodiment, the fuel injector is an air assist fuel injector 100 that is configured to utilize pressurized gas to atomize low pressure liquid fuel, which together travel through the air assist fuel injector along a direction of flow *f* as indicated in FIG. 2. In the illustrated embodiment, the fuel injector 100 is configured for use with a four-stroke internal combustion engine. However, in alternative embodiments the fuel injector is configured for operation with other engines. For example, the fuel injector 100 may be configured for operation with a two stroke internal combustion engine. Additionally, the fuel injector 100 need not be an air assist fuel injector. That is, in an alternative embodiment, the fuel injector 100 is configured to inject liquid fuel without the assistance of pressurized gas.

The fuel injector 100 includes a solenoid coil 114 of conductive wire wrapped around a tubular bobbin 112. The solenoid coil 114 has two ends that are each electrically connected to terminals 122. The solenoid coil 114 is energized by providing current to the terminals 122. The bobbin 112 of the solenoid assembly is a spool on which the conductor of the solenoid coil 114 is wound, and defines a through hole in or near which an armature 172 is electromagnetically actuated as further described below. As is illustrated in FIG. 2, the fuel injector 100 also includes a poppet 202, a seat 204, a leg 166, a spring 170, and a sleeve 168.

The armature 172 functions as the moving part of an electromagnetic actuator, defined by the solenoid coil 114 and armature 172 combination. As is illustrated in FIG. 2, the armature 172 of the air assist fuel injector 100 is located relative to the solenoid coil 114 such that the armature 172 is subject to the lines of magnetic flux generated by the solenoid coil 114. Hence, the armature 172 is actuated when the solenoid coil 114 is energized. The armature 172 is formed of a metallic material, preferably a ferromagnetic material, such as iron, nickel, and cobalt alloys. In a particularly preferred embodiment, the armature 172 if formed of a ferretic stainless steel, such as 430FR Stainless steel. Other suitable ferretic stainless steels include 405, 409, 429, 430 FSe, 434, 436, 442, and 446 standard stainless steels. The armature 172 is fabricated by casting, molding, forging, machining and/or other conventional metal working processes. The illustrated armature 172 is also located relative to the sleeve 168 such that the sleeve serves to guide the armature as the armature moves. In an alternative embodiment, the fuel injector 100 does not include the sleeve 168 and movement of the armature is not guided by a bearing. The illustrated armature 172 includes a conduit 180 that receives liquid fuel and gas from a cap 190 and that conveys the mixture of liquid fuel and gas to an inlet 182 of the poppet 202. In an alternative embodiment, the conduit 180 does not extent through the armature 172. In a further embodiment, the armature does not include the conduit 180. In this alternative embodiment, liquid fuel flows outside the armature and downstream the fuel injector 100.

As is described below, the poppet 202 is attached to the armature 172 at an interface location. Because the poppet 202 is attached to the armature 172, the poppet will move with armature when the armature is actuated by energizing the solenoid coil 114. The poppet 202 is a member that opens and closes to control the discharge of fuel from the fuel injector 100. When the poppet 202 opens and closes, it reciprocates in a channel 208 of the seat 204. In the illustrated embodiment, the poppet 202 includes a stem 212 and a head 214. The head 214 includes an impact surface 220 that abuts the seat 204 when the fuel injector is closed and that is spaced away from the seat 204 when the fuel injector is open. In the preferred embodiment, the impact surface 220 includes an angled and annular face that defines a contact ring, which contacts a surface of the seat 204 to define a seal between the poppet 202 and the seat. The poppet 202 is fabricated from a metallic material, such as iron, aluminum, titanium, and their alloys. In one embodiment, the poppet 202 is an austenitic, ferretic, or martensitic stainless steel. In a preferred embodiment, the poppet is formed of a 400 series stainless steel. Like the armature 172, the poppet 202 is fabricated by casting, molding, forging, machining, and/or other conventional metal working processes.

In the illustrated embodiment, the poppet 202 includes an interior channel 210 that extends from the inlet 182 of the poppet 202 to an outlet 232 of the poppet located upstream of the head 214. In the preferred embodiment, the poppet 202 includes four slot-shaped outlets 232 that are equally spaced from each other and located approximately transverse to a longitudinal axis of the poppet 202. Although it is preferred that the poppet 202 have four slot-shaped outlets 232, other configurations will suffice. For example, the poppet 202 may include one slot-shaped outlet, two circular outlets, five oval outlets, or ten pin sized outlets. Alternative embodiments of the poppet 202 need not include the inlet 182, the outlets 232, and the interior channel 210.

As is described above, the impact surface 220 of the head 214 seats against the seat 204 when the solenoid coil 114 is not energized. When the armature 172 is actuated by energizing the solenoid coil 114, the poppet 202 moves with the armature 172 such that the head 214 is lifted off of the seat 204 in a direction away from the fuel injector 100. Hence, the poppet 202 is an outwardly opening poppet. When the head 214 is lifted off of the seat 204, a seal is broken between the head 214 and the seat 204 such that liquid fuel and gas exiting the outlets 232 exits the fuel injector 100. In an alternative embodiment of the fuel injector 100, the poppet 202 is solid, i.e., it is devoid of an interior channel 210. In this solid-poppet embodiment, the liquid fuel travels exterior the poppet, as is common in many conventional fuel injectors. In another embodiment, the poppet 202 is an inwardly opening poppet. That is, to discharge the fuel from the fuel injector, the poppet and armature move opposite the direction of flow *f*. Such that the poppet head 214 lifts inwardly off of the seat 204 to discharge fuel from the fuel injector.

Movement of the poppet 202 is guided by a bearing 175 that is located upstream of the outlets 232 with respect to the direction of flow *f* of the liquid fuel and the gas through the injector 100. Hence, the seat 204 includes a bearing surface that engages a corresponding bearing surface of the poppet 202 to guide movement of the poppet. Because the seat 204 serves as a bearing surface for poppet movement and also absorbs the impact of the head 214 when the poppet 202 opens and closes, the seat 204 is preferably fabricated from a wear and impact resistant material such as hardened 440 stainless steel. In alternative embodiments, seat 204 need not include a bearing surface that guides movement of the poppet. For example, movement of the poppet 202 may be guided at other locations upstream of the seat 204. In an alternative embodiment, the fuel injector includes bearing surfaces between the seat 204 and the poppet 202 and between the armature 172 and the sleeve168.

As is further illustrated in FIG. 2, the poppet 202 moves within an elongated channel 165 of the leg 166. The leg 166 is an elongated body through which the poppet 202 reciprocates and that supports the seat 204. The interior channel 165 of the leg 166 through which the poppet 202 moves also serves as a secondary flow path for the pressurized gas. Hence, when the head 214 lifts off of the seat 204, pressurized gas flows outside of the poppet 202 but inside the leg 166 to help atomize the liquid fuel and the gas exiting the outlets 232. In an alternative embodiment, the leg 166 and the seat 204 are formed from a single, integral member such that the leg defines the same surfaces as the illustrated seat 204 and serves the same functions.

The spring 170 is located between the armature 172 and the leg 166. More particularly, the spring 170 is located within a recessed bore 171 of the leg 166 that is concentric with the elongated channel 165 of the leg 166. The bore 171 faces the armature 172 and defines the seat for the spring 170. The spring 170 is a compression spring having a first end that abuts the armature 172 and a second end that abuts the leg 166. The bottom of the bore 171 defines the seat for the downstream end of the spring and a recess in the armature 172 defines a seat for the upstream end of the spring 170. The spring 170 functions to bias the armature 172 away from the leg 166. When the solenoid coil 114 is not energized, the spring 170 biases the armature 172 away from the leg 166 and thus the poppet 202 is maintained in a closed position where the head 214 abuts the seat 204. However, when the solenoid coil 114 is energized, the electromagnetic forces cause the armature 172 to overcome the biasing force of the spring 170 such that the armature 172 moves toward the leg 166 until it abuts a stop surface 167 of the leg 166. When the solenoid coil 114 is de-energized, the electromagnetic force is removed and the spring 170 again forces the armature 172 away from the stop surface 167. As will be appreciated, in alternative embodiments of the fuel injector 100, the spring 170 may be located at different positions and still be within the confines of the present invention. For example, in one inwardly-opening embodiment of the fuel injector, the spring 170 is located at the upstream end of the armature and biases the armature toward the leg 166.

In the preferred embodiment, the fuel injector 100 also includes a cap 190 that defines an inlet to the air assist fuel injector 100 for the pressurized gas and liquid fuel. The cap 190 serves to direct the liquid fuel and gas to the passageway 180 of the armature 172. The cap 190 includes one fuel passageway 192 having an inlet that primarily receives liquid fuel and four gas passageways 194 each having an inlet that primarily receives pressurized gas. The liquid fuel passageway 192 is located along the center axis of the cap 190, and the gas passageways 194 are circumferentially and equally spaced about the liquid fuel passageway 192. Alternative embodiments of the air assist fuel injector 100 need not include the cap 190, and alternative embodiments of the cap 190 may include more or fewer passageways 192, 194.

As is described above, the illustrated fuel injector 100 utilizes pressurized gas, such as air, to atomize low pressure fuel. When installed in an engine, the fuel injector 100 is located such that the atomized low pressure fuel that exits the fuel injector 100 is delivered to the internal combustion chamber of an engine, i.e., that part of an engine at which combustion takes place, normally the volume of the cylinder between the piston crown and the cylinder head, although the combustion chamber may extend to a separate cavity outside this volume. For example, the fuel injector 100 may be located in a cavity of a four-stroke internal combustion engine head such that the fuel injector can deliver a metered quantity of atomized liquid fuel to a combustion cylinder of the four-stroke internal combustion engine where it is ignited by a spark plug or otherwise.

Because the fuel injector 100 is an air assist fuel injector, in a typical configuration, the air assist fuel injector 100 is located adjacent a conventional fuel injector (not illustrated), which delivers metered quantities of fuel to the air assist fuel injector. The conventional fuel injector may be located in the cavity of a rail or within a cavity in the head of an engine. The air assist fuel injector 100 is referred to as "air assist" because it preferably utilizes pressurized air to atomize liquid fuel. Although it is preferred that the air assist fuel injector 100 atomize liquid gasoline with pressurized air, it will be appreciated that the air assist fuel injector 100 may atomize many other liquid combustible forms of energy with any variety of gases. For example, the air assist fuel injector 100 may atomize kerosene or liquid methane with pressurized gaseous oxygen, propane, or exhaust gas. Hence, the term "air assist" is a term of art, and as used herein is not intended to dictate that the air assist fuel injector 100 be used only with pressurized air. As mentioned above, in alternative embodiments, the fuel injector 100 is not an air assist fuel injector as it is configured to deliver fuel without the assistance of a gas.

Figure 5:
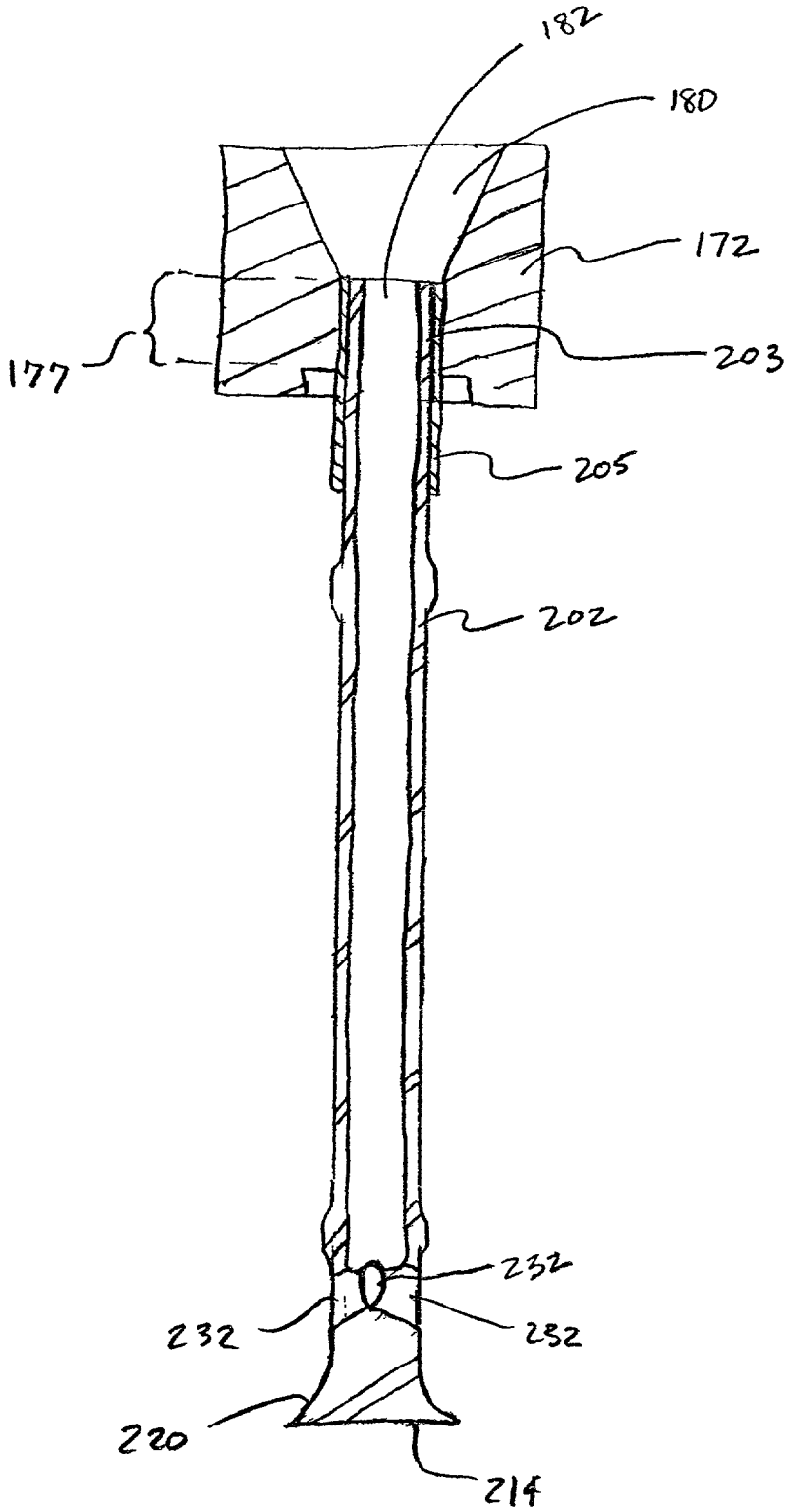
FIG. 5 is a cross-sectional view of the poppet and the armature of FIG. 4 taken along the line 5—5 in FIG. 4.
Figure 6:
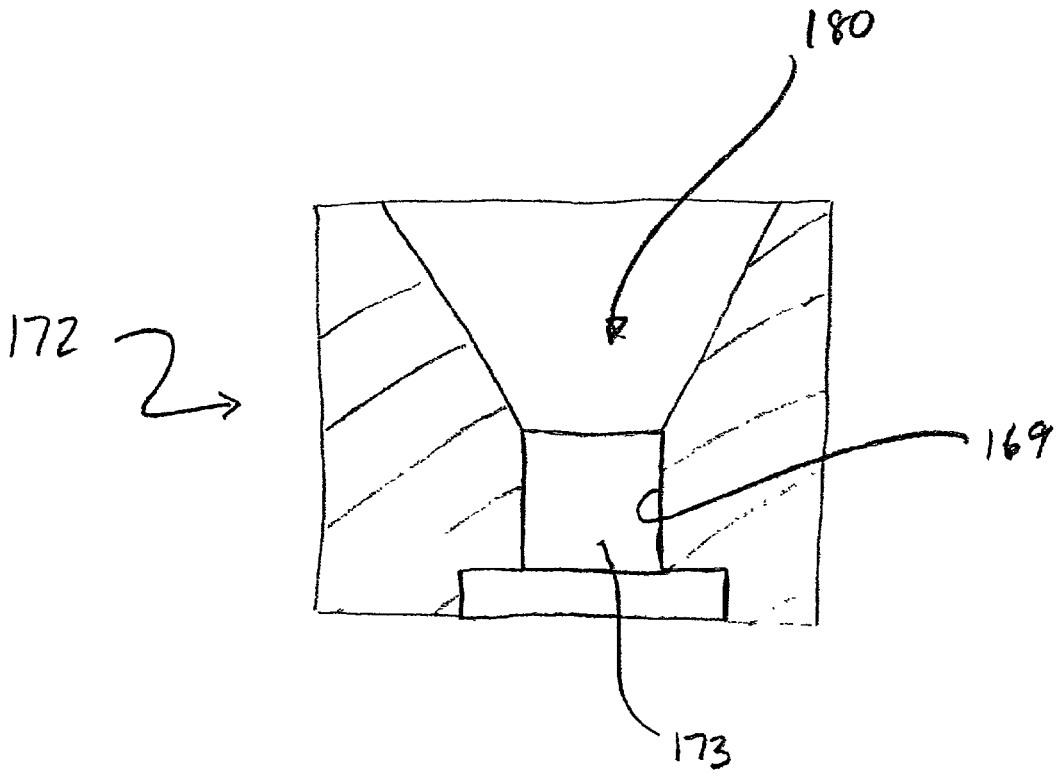
FIG. 6 is a cross-sectional view of the armature of FIG. 4.

As is described above and as best illustrated in FIG. 5, the poppet 202 and the armature 172 are attached to each other at an interface location 177, which is the location where the armature 172 and poppet 202 abut each other. In the illustrated embodiment of the armature 172, the conduit 180 includes a cylindrical portion or recess 173 that receives a cylindrical end portion 203 of the poppet 202 such that the interface location 177 is a cylindrical joint between the armature and the poppet. During the manufacture of the fuel injector 100, the poppet 202 is attached to the armature 172 by press-fitting the end portion 203 of the poppet into the cylindrical recess 173 of the armature 172. The poppet 202 and the armature 172 are then welded together using, preferably, a YAG laser weld. However, alternative attachments are also contemplated. For example, the poppet 202 may be attached to the armature 172 in other manners, such as solely by an interference fit, an adhesive, a threaded or screwed attachment, a lock-and-key attachment, a retaining ring attachment, an electron beam weld, or an ultrasonic weld.

As is set forth above, the poppet-armature interface location of some conventional fuel injectors is susceptible to corrosion. The embodiments of the present invention strive to address this problem by including a coating 205 on the poppet 202 and/or on the armature 172 over all or at least a portion of the interface location 177.

The coating 205 is a layer of substance spread over and bonded to a surface of the poppet 202 and/or the armature 172 at the interface location 177 and has an increased resistance to corrosion (i.e., corrodes at a slower rate in mils penetration per year) as compared with the base material of the poppet and/or the base material of the armature when each is exposed to a same working environment. This increased resistance to corrosion of the coating 205 may be an increased resistance (as measured relative to the base material of the armature 172 and/or the base material of the poppet 202 without the coating 205) to one or more of the following types of corrosion: uniform corrosive attack; galvanic corrosion; crevice corrosion; pitting corrosion; intergranular corrosion; erosion corrosion; and stress corrosion cracking. The coating 205 is a solid-phase, i.e., non-fluid, after its application and is one or more of numerous coatings that increase corrosion resistance, such as organic coatings, inorganic coatings, and metallic coatings. Suitable organic coatings include dried paints, varnishes, lacquers, and synthetic resins. Suitable inorganic coatings include dried enamels, oxides, and phosphate conversions. Examples of suitable metallic coatings include tin based coatings, cadmium based coatings, gold based coatings, silver based coatings, platinum based coatings, aluminum based coatings, titanium based coatings, zinc based coatings, chromium based coatings, nickel based coatings, carbon based coatings, iron based coatings, and other known coatings. Examples of some preferred classes of metallic coatings include chromium nitride coatings, nickel phosphorous coatings, diamond-like-carbon coatings, nickel coatings, and iron nitride coatings. Suitable coatings may be applied by hot or cold dipping, electroplating, spraying, and by deposition from solution. In the illustrated embodiment the coating 205 is preferably a chromium based coating, commercially available as ARMOLOY-TDC from Armoloy, Inc., Pennsylvania, USA, and is deposited on the cylindrical, exterior surface of the end portion 203 of the poppet 202 via an electrochemical bath. The coating 205 preferably extends from the extreme or most distal end 179 to a location downstream of the interface location 177 as measured with respect to the direction of flow f. Hence, in the illustrated embodiment, the coating 205 extends from the most distal end 179 to a location 10 mm downstream thereof, which is approximately 6 mm downstream of the most downstream end of the interface location 177. In alternative embodiments, the coating 205 does not extend downstream of the interface location 177. In a further embodiment, the coating 205 covers the entire exterior surface of the poppet 202.

In an alternative embodiment, the poppet 202 does not include the coating 205. Rather, the recess 173 of the armature 172 that receives the poppet 202 includes the coating 205. For example, in one embodiment, the interior cylindrical surface 169 of the recess 173 of the conduit 180 is coated with the coating 205. In a further embodiment, the end portion 203 of the poppet 202 and the recess 173 of the armature 172 each include an identical or different coating 205.

By coating at least one of the armature and poppet surfaces at the interface location with the coating 205, the attached components are less likely to become corroded as compared to some conventional configurations. Additionally, the coating 205 provides some lubricity to the components, thereby decreasing the amount of galling that takes place when the poppet 202 is inserted into the armature 172 (or vice versa) which is thought to contribute to the corrosion of some conventional designs.

Figure 7:
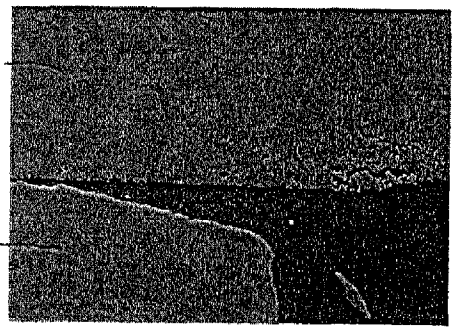
FIGS. 7 and 8 are magnified views of a portion of a poppet-armature interface of an uncoated, control poppet-armature combination after being exposed to a corrosive environment.
Figure 8:
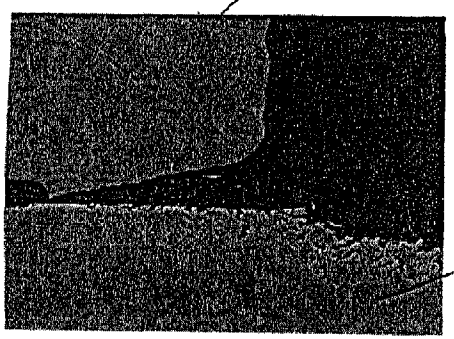
Figure 9:
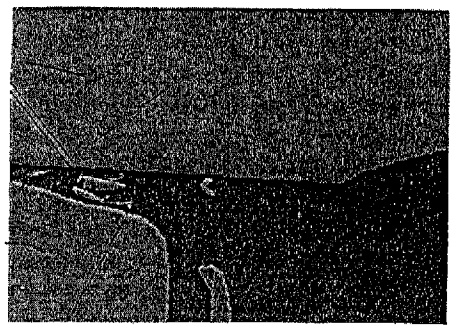
FIGS. 9 and 10 are magnified views of a portion of a poppet-armature interface of a coated, test poppet-armature combination in accordance with an embodiment of the present invention after being exposed to a corrosive environment.
Figure 10:
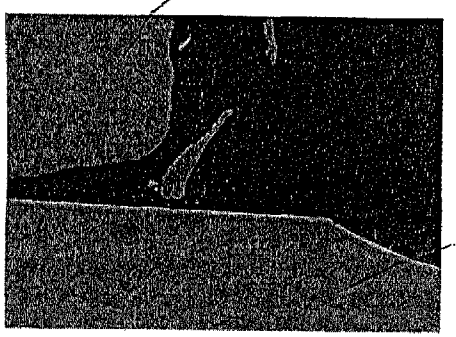

FIGS. 7–10 illustrate the results of testing that confirms the efficiency of one preferred coating. A 2 μm chromium based coating (commercially available as ARMOLOY-TDC) was applied to an exterior surface of an end portion of several test poppets 202*a* via a vapor deposition method. The coating 205 extended from the extreme or most distal end of the test poppets 202*a* to a location about 15 mm downstream of the interface location as measured with respect to the direction of flow f. Each of the coated test poppets 202*a* were then attached to an armature 172*a* by press-fitting the end portion of the coated test poppets into the cylindrical recess of the armatures 172*a* and then welding the poppets to the armatures using a YAG laser weld. Several control poppets 202*b*, i.e., poppets without a coating thereon, were also attached to armatures 172*b* using the above standard production process. The test and control poppet-armature combinations were then subjected to a salt fog environment for 48 hours per ASTM B-117. The test and control combinations were then rinsed and placed in an ambient environment for 30 days. Generally speaking, at the end of the testing, the uncoated, control poppet-armature combinations experienced a significant amount of corrosion of the base material of the poppets and the armatures at the poppet-armature interface location. For purposes of illustration, FIGS. 7 and 8 illustrate the corrosion at different portions of the poppet-armature interface location (with a 90 X magnification) of one of the uncoated, control poppet-armature combinations. Conversely, the coated, test poppet-armature combinations did not experience a significant amount of corrosion of the base material of the poppet or the armature at the interface location as compared to the control samples. For purpose of illustration, FIGS. 9 and 10 illustrate portions of the poppet-armature interface location (with a 90 X magnification) of one of the coated, test poppet-armature combinations.

FIGS. 11–18 illustrate alternative embodiments of poppets 1202, 2202, 3202, 4202 and armatures of fuel injectors in accordance with embodiments of the present invention. The foregoing discussion of the components, benefits, and functions of the poppet 202 and armature 172 also applies to poppets 1202, 2202, 3202, and 4202 and armatures 1172, 2172, 3172, and 4172. Thus, the components and the features of the poppets and the armatures illustrated in FIGS. 11–18 have been assigned reference numbers that correspond to the reference numbers of the poppet 202 and armature 172, increased by thousands. The poppets 1202, 2202, 3202, 4202 and the armatures 1172, 2172, 3172, 4172 illustrated in FIGS. 11–18 also include additional features and inherent functions, as described below.

Figure 11:
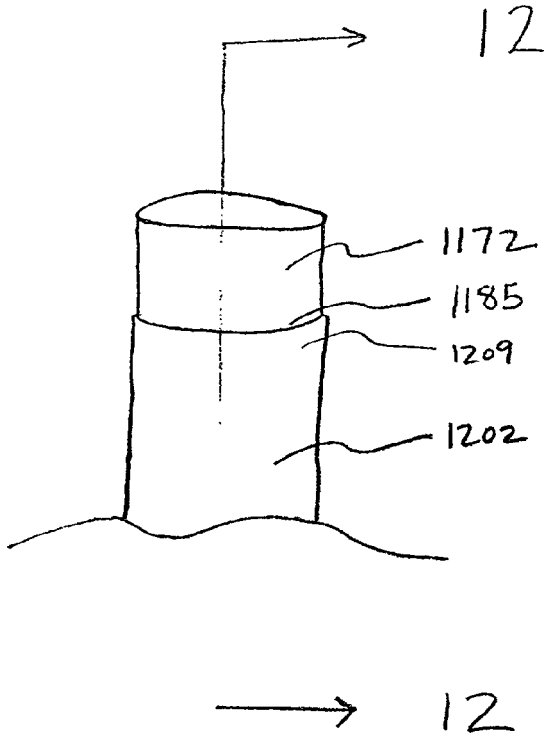
FIG. 11 is a side view of another embodiment of an attached poppet and armature of a fuel injector in accordance with an embodiment of the present invention.
Figure 12:
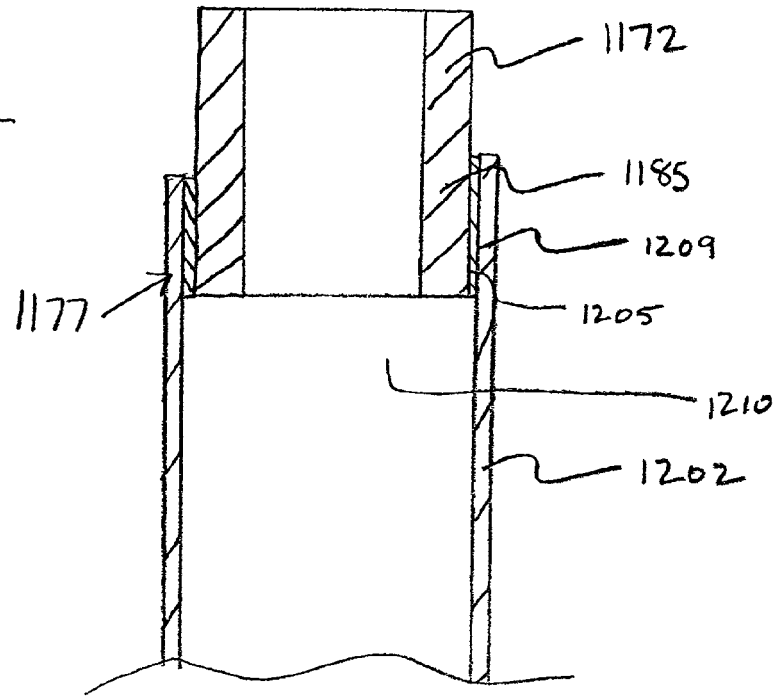
FIG. 12 is a cross-sectional view of the attached poppet and armature illustrated in FIG. 11 taken along the line 12—12 in FIG. 11.

FIGS. 11 and 12 illustrate another embodiment of a poppet 1202 attached to an armature 1172 of a fuel injector in accordance with the present invention. In this embodiment, the poppet 1202 includes an interior channel or recess 1210. The channel 1210 may extend to an outlet of the poppet or only partially into the poppet an amount sufficient to receive the armature 1172. The interior channel 1210 includes a cylindrical portion 1209 that receives a cylindrical end portion 1185 of the armature 1172 such that the interface location 1177 is a cylindrical joint between the poppet 1202 and the armature. Similar to the above-described embodiment, armature 1172 is attached to the poppet 1202, such as by an interference fit, an adhesive, a threaded or screwed attachment, a lock-and-key attachment, a retaining ring attachment or a weld. In this embodiment, the inside diameter of the cylindrical portion 1209 of the poppet 1202 includes a coating 1205. Similar to the above-described embodiment, the coating 1205 has an increased resistance to corrosion as compared to the base material of the poppet 1202 and/or the base material of the armature 1172 such that these components are less likely to become corroded at the interface location.

In an alternative embodiment, the poppet 1202 does not include the coating 1205. Rather, the outside diameter of the cylindrical end portion 1185 of the armature 1172 includes the coating 1205. In a further alternative embodiment, both the inside diameter of the cylindrical portion 1209 of the poppet interior channel 1210 and the outside diameter of the cylindrical end portion 1185 of the armature 1172 include the coating.

Figure 13:
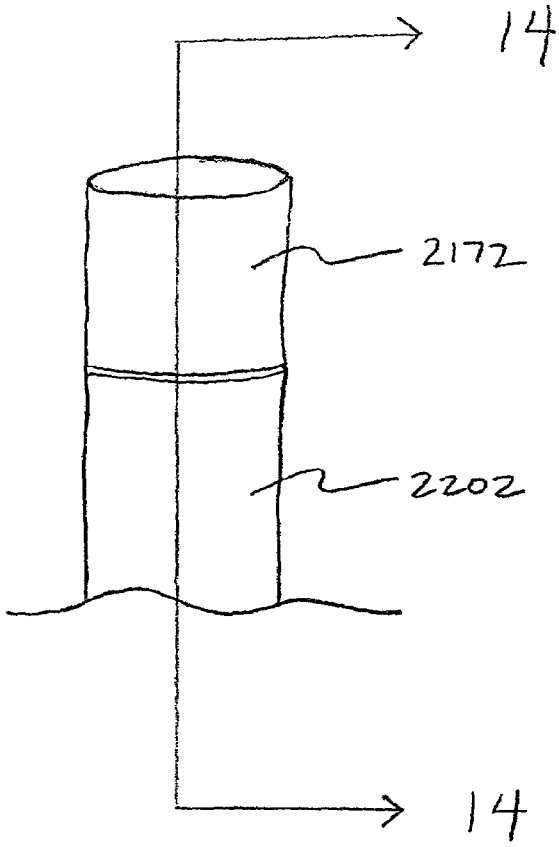
FIG. 13 is a side view of a further embodiment of an attached poppet and armature of a fuel injector in accordance with an embodiment of the present invention.
Figure 14:
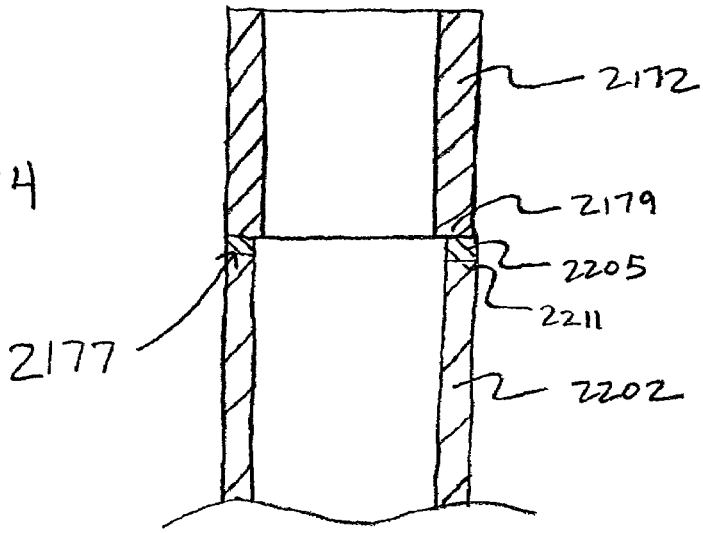
FIG. 14 is a cross-sectional view of the attached poppet and armature illustrated in FIG. 13 taken along the line 14—14 in FIG. 13.

FIGS. 13 and 14 illustrate another embodiment of a poppet 2202 attached to an armature 2172 a fuel injector in accordance with the present invention. In this embodiment, the poppet 2202 includes an end 2211 that abuts an end 2179 of the armature 2172 such that the interface location 2177 is an annular joint between the poppet and the armature. Similar to the above-described embodiments, the poppet 2202 is attached to the armature 2172, such as by a weld or an adhesive. In this embodiment the end 2211 of the poppet 2202 includes a coating 2205. Similar to the above-described embodiments, the coating 2205 has an increased resistance to corrosion as compared to the base material of the poppet 2202 and/or the base material of the armature 2172 such that these components are less likely to become corroded at the interface location.

Figure 15:
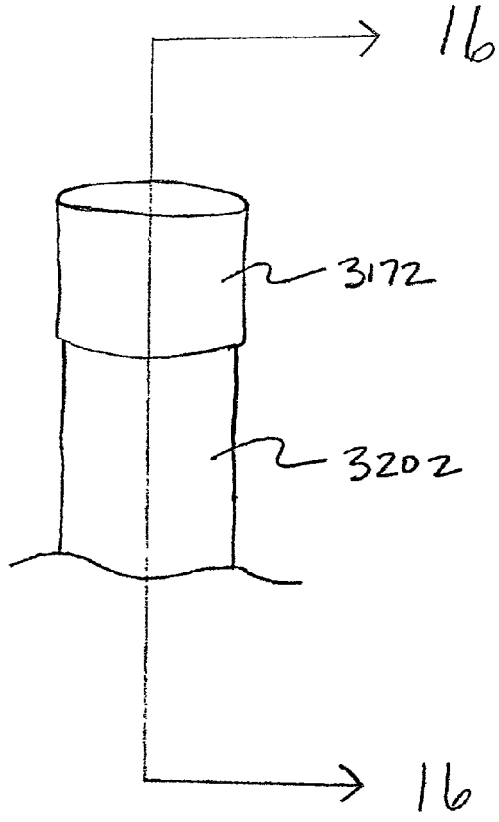
FIG. 15 is a side view of an additional embodiment of an attached poppet and armature of a fuel injector in accordance with an embodiment of the present invention.
Figure 16:
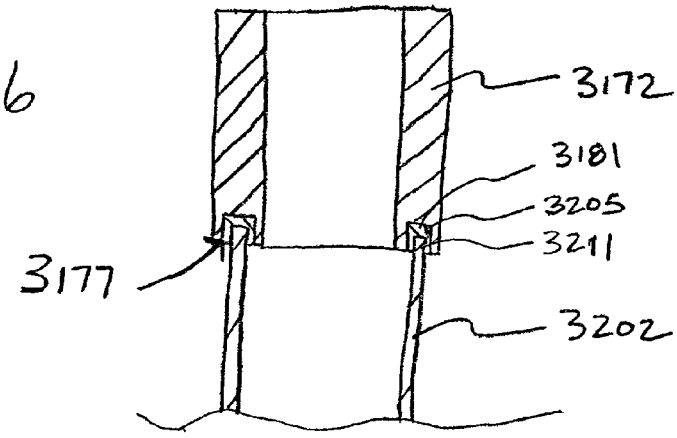
FIG. 16 is a cross-sectional view of the attached poppet and armature illustrated in FIG. 15 taken along the line 16—16 in FIG. 15.

FIGS. 15 and 16 illustrate another embodiment of a poppet 3302 attached to an armature 3172 of a fuel injector in accordance with the present invention. In this embodiment, the armature 3172 includes a recess in toe form of a receiving groove 3181. The groove 3181 matingly receives an end 3211 of the poppet 3202 such that the interface location 3177 is a cylindrical and annular joint between the armature 3172 and the poppet. Similar to the above-described embodiment, the poppet 3202 is attached to the armature 3172, such as by an interference fit or a weld. In this embodiment the annular edge outside diameter, and inside diameter of the first end 3211 of the poppet 3202 includes a coating 3205. Similar to the above-described embodiments, the coating 3205 has an increased resistance to corrosion as compared to the base material of the poppet 3202 and/or the base material of the armature 3172 such that these components are less likely to become corroded at the interface location.

In an alternative embodiment, the outside diameter of the first end 3211 of the poppet 3202 does not include the coating. Rather, the inside surfaces of the groove 3181 include the coating.

Figure 17:
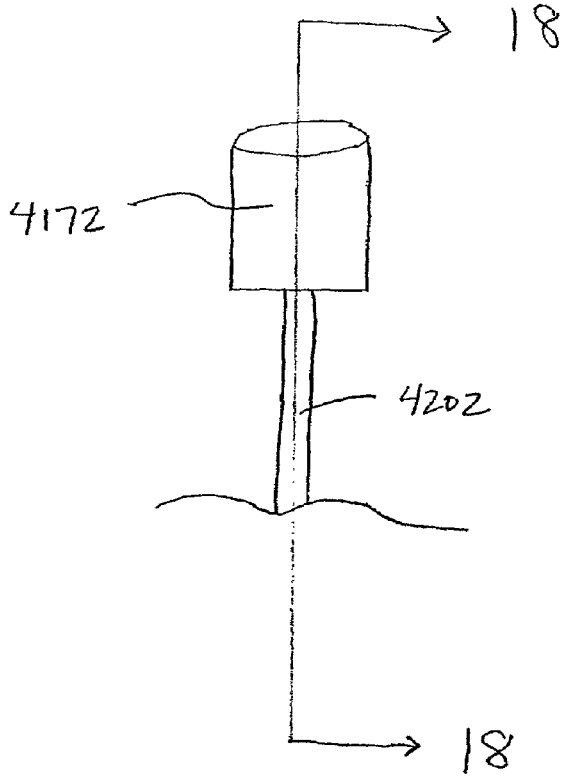
FIG. 17 is a side view of another embodiment of an attached poppet and armature of a fuel injector in accordance with an embodiment of the present invention.
Figure 18:
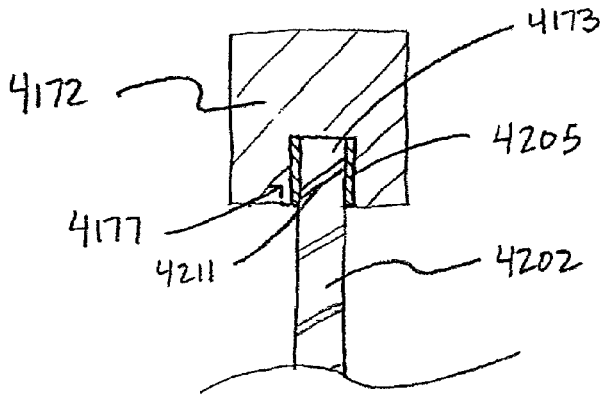
FIG. 18 is a cross-sectional view of the attached poppet and armature illustrated in FIG. 17 taken along the line 18—18 in FIG. 17.

FIGS. 17 and 18 illustrate another embodiment of a poppet 4202 attached to an armature 4172 of a fuel injector in accordance with the present invention. The poppet 4202 and the armature 4172 are solid and devoid of any through-oles. The poppet 4202 includes a cylindrical first end 4211 and the armature 4172 includes a cylindrical recess 4173 that receives the first end 4211 such that the interface location 4177 is a cylindrical joint between the armature 4172 and the poppet 4202. Similar to the above-described embodiment, the poppet 4202 is attached to the armature 4172 such as by a weld, an interference fit, an adhesive, a threaded or screwed attachment, a lock-and-key attachment, and/or a retaining ring attachment. In this embodiment, the liquid fuel and gas flow along the exterior surfaces of the armature and the poppet rather than through the components. As is illustrated in FIG. 18, the outside diameter of the first end 4211 of the poppet 4202 includes a coating 4205. Similar to the above-described embodiments, the coating 4205 has an increased resistance to corrosion as compared to the base material of the poppet 4202 and/or the base material of the armature 4172 such that these components are less likely to become corroded at the interface location.

In an alternative embodiment, the outside diameter of the first end 4211 of the poppet 4202 does not include the coating. Rather, the inside surface of the recess 4173 includes the coating. In a further alternative embodiment, both the outside diameter of the first end portion 4211 of the poppet 4202 and the inside surface of the recess 4173 include the coating.

The principles, preferred embodiments, and modes of operation of the present invention have been described in the foregoing description. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes, and equivalents which fall within the spirit and scope of the present invention as defined in the claims be embraced thereby.

What is claimed is:

1. An assembly for a fuel injector comprising:

an armature of a metallic material; and a poppet of metallic material, said poppet being attached to said armature at an interface location, at least one of said armature and said poppet including a solid phase coating thereon at said interface location, said coating having a higher resistance to corrosion than at least one of said metallic material of said armature and said metallic material of said poppet, said poppet having an inlet, an outlet, and a passageway communicating said inlet with said outlet.

2. The assembly of claim 1, said coating being at least one of a chromium based coating, a nickel based coating, a carbon based coating, an iron based coating, a tin based coating, a cadmium based coating, a gold based coating, a silver based coating, a platinum based coating, an aluminum based coating, a titanium based coating, and a zinc based coating.

3. The assembly of claim 1, further comprising:

a solenoid for moving said armature when said solenoid is energized.

4. The assembly of claim 3, further comprising:

a seat for said poppet.

5. The assembly of claim 1, said armature having a first end, a second end, and a conduit extending between said first end and said second end, said conduit matingly receiving a portion of said poppet to define said interface location where said poppet is attached to said armature.

6. The assembly of claim 1, said metallic material of said armature being stainless steel.

7. The assembly of claim 1, said metallic material of said poppet being stainless steel.

8. The assembly of claim 1, said armature including said coating.

9. The assembly of claim 8, said armature having a recessed portion that receives said poppet to define said interface location where said poppet is attached to said armature, said coating being on a surface of said recessed portion.

10. The assembly of claim 9, said recessed portion being part of a conduit that passes through said armature, said coating only covering a portion of said conduit.

11. The assembly of claim 1, said poppet including said coating.

12. The assembly of claim 11, said poppet including an exterior surface, said coating being on at least a portion of said exterior surface.

13. The assembly of claim 12, said exterior surface being a cylindrical surface, said coating only covering a portion of said cylindrical surface.

14. The assembly of claim 13, said portion of said cylindrical surface including at least an area of said poppet that is received by said armature.

15. The assembly of claim 1, said coating being applied by at least one of an electroplating process, a spraying process, a hot dipping process, a diffusion process, a chemical bath process, and a vapor deposition process.

16. The assembly of claim 1, said coating being substantially only at said interface location.

17. The assembly of claim 1, said passageway receiving a portion of said armature to define said interface location where said poppet is attached to said armature.

18. A fuel injector comprising:

an armature of a metallic material;

a poppet of a metallic material, said poppet being attached to said armature at an interface location; and a solenoid for moving said armature when said solenoid is energized, at least one of said armature and said poppet including a solid phase coating thereon at said interface location, said coating having a higher resistance to corrosion than at least one of said metallic material of said armature and said metallic material of said poppet, said poppet having an inlet, an outlet, and a passageway communicating said inlet with said outlet.

19. The fuel injector of claim 18, said fuel injector being an air assist fuel injector.

20. The fuel injector of claim 18, said coating being at least one of a chromium based coating, a nickel based coating, a carbon based coating, an iron based coating, a tin based coating, a cadmium based coating, a gold based coating, a silver based coating, a platinum based coating, an aluminum based coating, a titanium based coating, and a zinc based coating.

21. The fuel injector of claim 18, said armature having a first end, a second end, and a conduit extending between said first end and said second end, said conduit matingly receiving a portion of said poppet to define said interface location where said poppet is attached to said armature.

22. The fuel injector of claim 18, said poppet being attached to said armature by a weld.

23. The fuel injector of claim 18, said poppet having a receiving portion that receives a portion of said armature to define said interface location where said poppet is attached to said armature.

24. The fuel injector of claim 18, said coating being substantially only at said interface location.

25. An assembly for a fuel injector comprising:

a metallic armature;

a metallic poppet attached to said armature at an interface location; and coating means for providing higher resistance to corrosion than at least one of said metallic armature and said metallic poppet at said interface location, said poppet having an inlet, an outlet, and a passageway communicating said inlet with said outlet.

26. The assembly of claim 25, said armature having a receiving portion that receives a portion of said poppet to define said interface location where said poppet is attached to said armature.

27. The assembly of claim 25, said poppet having a receiving portion that receives a portion of said armature to define said interface location where said poppet is attached to said armature.

28. The assembly of claim 25, said coating means being substantially only at said interface location.

29. An assembly for a fuel injector comprising:

a metallic armature;

a metallic poppet attached to said armature; and a solid phase coating previously applied on at least one of said armature and said poppet by a dipping process, an electroplating process, a spraying process, or a deposition process, said coating being at a location where said poppet is attached to said armature, said coating having a higher resistance to corrosion than at least one of said metallic armature and said metallic poppet, said poppet having an inlet, an outlet, and a passageway communicating said inlet with said outlet.

30. The assembly of claim 29, said coating being a chromium based material.

31. The assembly of claim 29, said coating being a nickel based material.

32. The assembly of claim 29, said coating being a carbon based material.

33. The assembly of claim 29, said coating being an iron based material.

34. The assembly of claim 29, said coating being substantially only at a location where said poppet is attached to said armature.

35. A method of assembling a fuel injector comprising:

attaching a poppet of a metallic material to an armature of a metallic material at an interface location; and prior to attaching the poppet to the armature, coating at least one of the poppet and the armature with a solid phase coating, the coating having a higher resistance to corrosion than at least one of the metallic material of the poppet and the metallic material of the armature, said poppet having an inlet, an outlet, and a passageway communicating said inlet with said outlet.

36. The method of claim 35, said attaching the poppet to the armature comprising:

inserting the poppet into the armature.

37. The method of claim 35, said attaching the poppet to the armature further comprising:

welding the poppet to the armature.

38. The method of claim 35, said attaching the poppet to the armature comprising:

inserting the armature into the poppet.

39. The method of claim 38, said attaching the poppet to the armature further comprising:

welding the poppet to the armature.

40. The method of claim 35, said coating at least one of the poppet and the armature including at least one of the following steps:

applying the coating via an electroplating process;

applying the coating via a dipping process;

applying the coating via a deposition process; and applying the coating via a spraying process.

41. The method of claim 35, said coating being substantially only at said interface location.

42. A fuel injector comprising:

an armature; and a poppet of metallic material, said poppet being attached to said armature at an interface location, said poppet having a distal portion, a proximal portion, and an intermediate portion located between said distal portion and said proximal portion, said proximal portion including said interface location, said distal portion including a bearing surface and a poppet head, said poppet including a solid phase coating thereon at said interface location, said coating not being at said distal portion, said coating having a higher resistance to corrosion than said metallic material of said poppet, said poppet having an inlet, an outlet, and a passageway communicating said inlet with said outlet.

43. The fuel injector of claim 42, said armature having a first end, a second end, and a conduit extending between said first end and said second end, said conduit matingly receiving a portion of said poppet to define said interface location where said poppet is attached to said armature.

44. The fuel injector of claim 42, said armature having a recessed portion that receives said poppet to define said interface location where said poppet is attached to said armature.

45. The fuel injector of claim 42, said fuel injector being an air assist fuel injector.

46. The fuel injector of claim 42, said passageway receiving a portion of said armature to define said interface location where said poppet is attached to said armature.

47. A fuel injector comprising:

an armature of a metallic material; and a poppet attached to said armature at an interface location, said armature having a receiving portion that receives a portion of said poppet to define said interface location where said poppet is attached to said armature, said armature including a solid phase coating thereon at said interface location, said armature having a bearing surface, said coating not being at said bearing surface, said coating having a higher resistance to corrosion than said metallic material of said armature, said poppet having an inlet, an outlet, and a passageway communicating said inlet with said outlet.

48. The fuel injector of claim 47, said fuel injector being an air assist fuel injector.

49. The fuel injector of claim 47, said armature having a first end, a second end, and a conduit extending between said first end and said second end, said conduit including said receiving portion.

50. The fuel injector of claim 47, said poppet being attached to said armature by a weld.

51. A fuel injector comprising:

an armature; and a poppet of a metallic material having an end portion for attachment to said armature, only said end portion of said poppet having a solid phase coating thereon, said coating having a higher resistance to corrosion than said metallic material of said poppet, said poppet including an inlet, an outlet; and a passageway communicating said inlet with said outlet.

* * * * *